US006220728B1

(12) United States Patent
Andrus et al.

(10) Patent No.: US 6,220,728 B1
(45) Date of Patent: Apr. 24, 2001

(54) QUICK RELEASE PORTABLE LIGHT MOUNTING SYSTEM

(75) Inventors: Don Andrus, High Point, NC (US); Pei Sheng Qian, Shanghai (CN)

(73) Assignee: Regent Lighting Corporation, Burlington, NC (US)

( * ) Notice: Subject to any disclaimer, the term of this patent is extended or adjusted under 35 U.S.C. 154(b) by 0 days.

(21) Appl. No.: 09/358,242

(22) Filed: Jul. 21, 1999

(51) Int. Cl.[7] ..... F21V 21/29

(52) U.S. Cl. ..... 362/287; 362/414; 362/431; 362/421; 362/226

(58) Field of Search ..... 362/413, 414, 362/410, 431, 421, 287, 226

(56) References Cited

U.S. PATENT DOCUMENTS 1,574,908 * 3/1926 Lamp ..... 240/2
3,104,067 * 9/1963 Stiffel ..... 362/431
3,790,770 * 2/1974 Stern ..... 240/2
4,484,255 * 11/1984 Warshawsky ..... 362/396
6,092,907 * 7/2000 Brantley et al. ..... 362/119

* cited by examiner

*Primary Examiner*—Sandra O'Shea
*Assistant Examiner*—Ali Alavi
(74) *Attorney, Agent, or Firm*—Niro, Scavone, Haller & Niro

(57) ABSTRACT

A worklight mounting system having a post extending from a support and a light having a catch. The post is insertable into the catch and is releasably secured within the catch by the coaction between a groove and at least one roller. The coaction there between prevents axial movement while permitting rotational movement there between.

5 Claims, 3 Drawing Sheets

FIG. 1
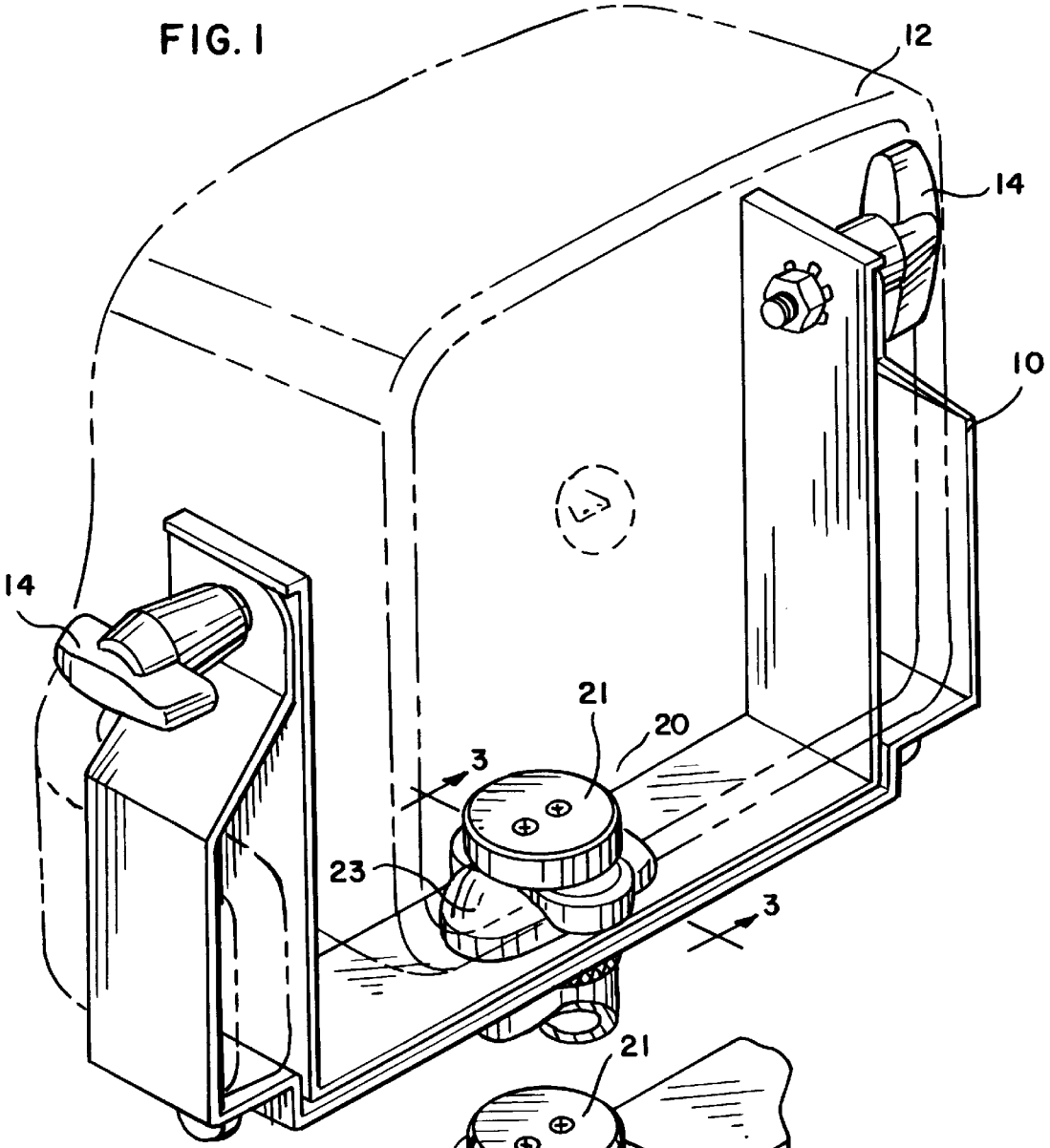
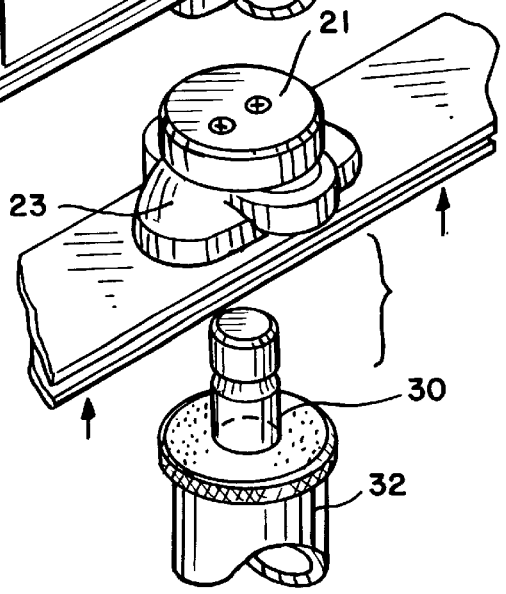
FIG. 2

FIG. 3
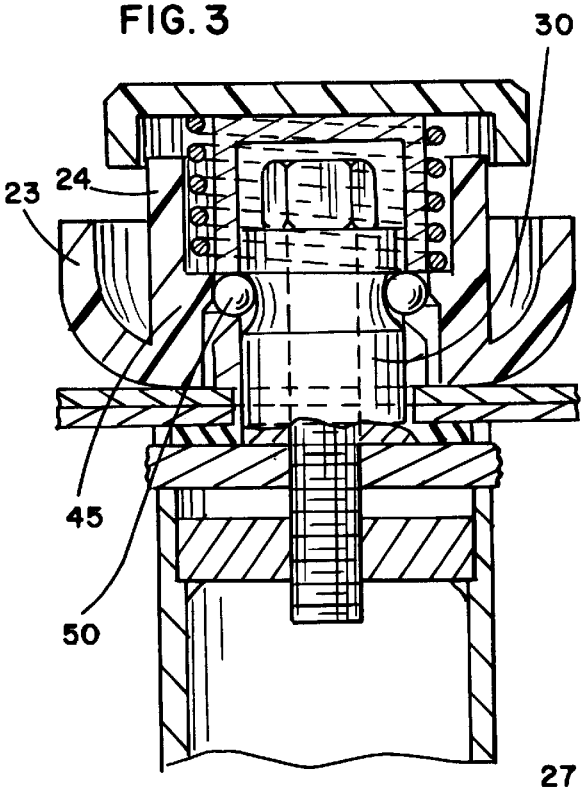
FIG. 5
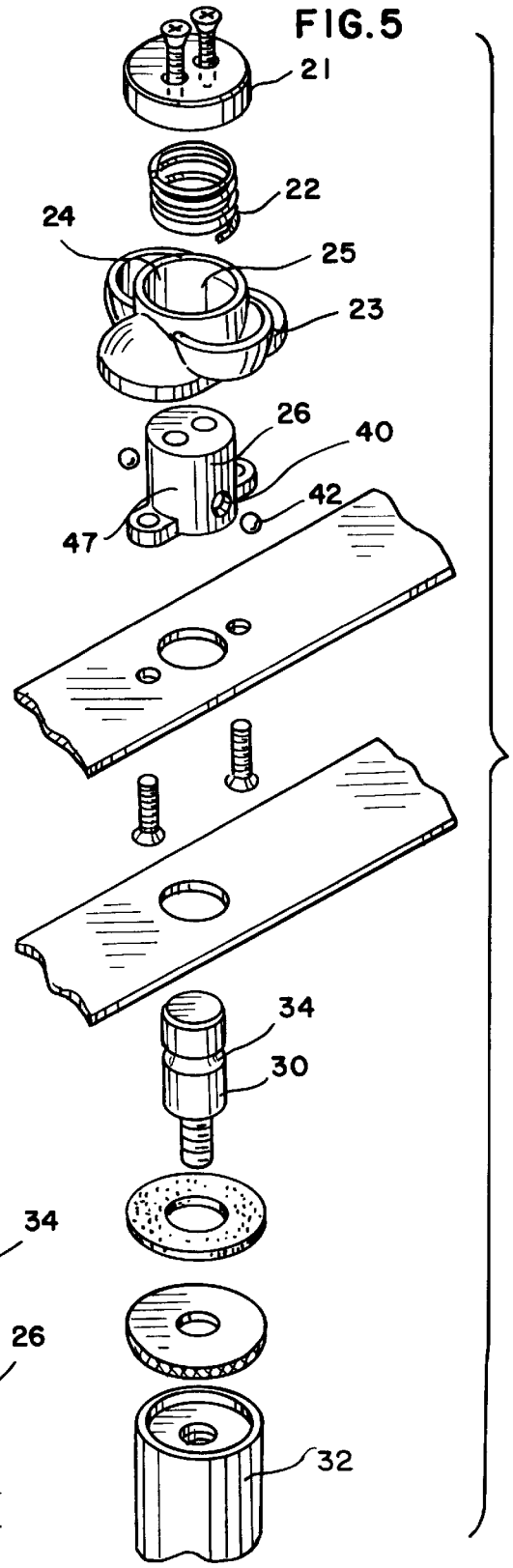
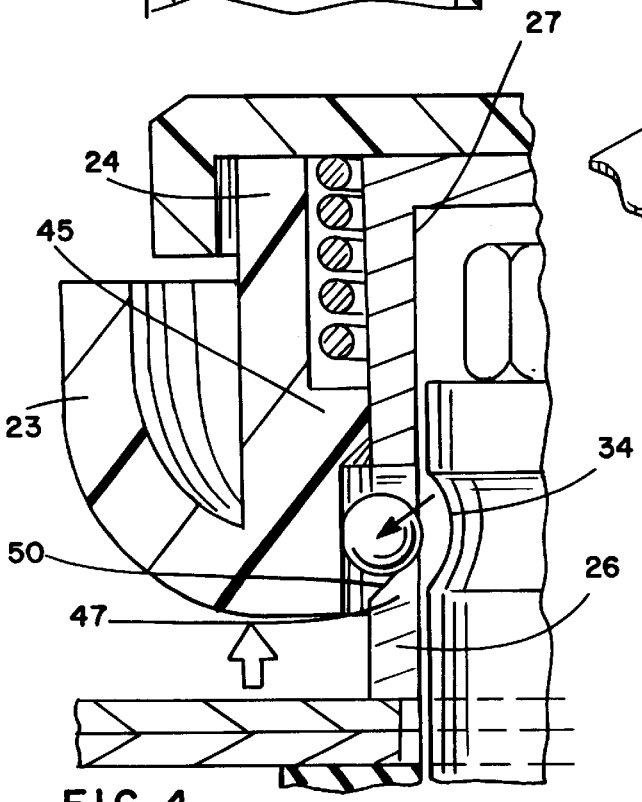
FIG. 4

QUICK RELEASE PORTABLE LIGHT MOUNTING SYSTEM

BACKGROUND OF THE INVENTION

The invention relates to a quick mounting system for use with a work light. More specifically, the invention relates to a mount which releasably affixes a light housing to a support structure such as stand, clamp, or other support means.

SUMMARY OF THE INVENTION

In the work light field, there are many types of halogen work lights with several common ones, being a stand light, a portable floor light, and a clamp light. A stand light, as the name suggests, uses a stand to elevate a light housing, in most instances, several feet off the ground for use. A portable floor light, on the other hand, is often placed upon a floor through the use of a base or legs which typically elevate the light no more than several inches off of the floor. A clamp light has a light housing affixed to a clamp which, in turn, may be affixed to a wide variety of objects.

The present invention provides a mounting system which allows a typical light housing to be quickly and easily mounted to any number of different support structures such as a stand, base, legs, clamp, and the like. The mounting system does this by providing a post which has a groove on the support structure. The light housing, in turn, includes a bracket which has a catch. The catch is adapted to releasably engage the post for ease of mounting and dismounting.

DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

FIG. 1 is a perspective view of one embodiment of the present invention.

FIG. 2 is an exploded perspective view of the embodiment shown in FIG. 1 with the post detached from the mount.

FIG. 3 is a cross-sectional view showing the roller engaging the post.

FIG. 4 is a cross-sectional view showing how the roller is disengaged from the post.

FIG. 5 is an exploded perspective view.

DETAILED DESCRIPTION OF THE PREFERRED EMBODIMENT

Figure 7:
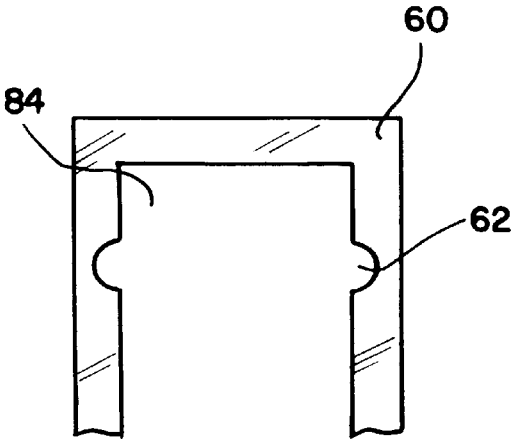
FIG. 7 shows the engagement between the groove and rollers for the embodiment shown in FIG. 6.
Figure 7:
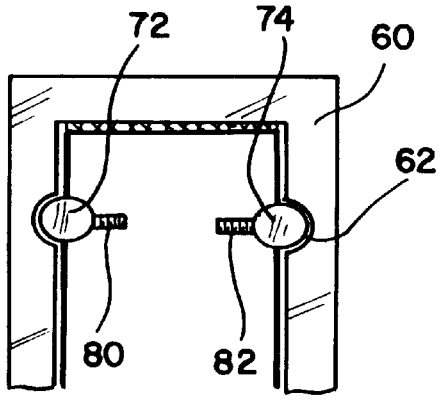

Set forth below is a description of what are currently believed to be the preferred embodiments or best examples of the invention claimed. Future and present alternatives and modifications to the preferred embodiments are contemplated. Any alternates or modifications in which insubstantial changes in function, in purpose, in structure or in result are intended to be covered by the claims of this patent.

As shown in FIG. 1, the present invention provides a bracket or frame 10 to which a light housing 12 (shown partially in phantom) may be secured by fasteners 14. Also included on frame 10 is a catch 20 which is adapted to releasably engage a post 30 which is located on a support 32 which may be a pole which extends upwardly from stand (not shown), a clamp, a support base, or some other suitable support to which the light housing may be affixed. Post 30 includes a groove 34.

Catch 20 includes a cap 21, interior spring 22, and outer housing 23 defining a sleeve 24 having bore 25 and inwardly directed finger 45. Coaxially located within bore 25 is second sleeve 26 which defines a second bore 27 which is adapted to receive post 30. Sleeve 26 is mounted to bracket 10 and includes an aperture 40 in which roller 42 rests.

In use, light housing 12 is mounted to support 32 by inserting post 30 into bore 27 located in catch 20. As shown in FIG. 3, post 30 is inserted until roller 42, which is urged inwardly by finger 45, engages groove 34. The engagement is maintained by spring 22 which is urged against cap 21 and finger 45 and maintains finger 45 in the proper spatial relationship with respect to roller 42. Roller 42 only partially extends through wall 47 of sleeve 26 and is prevented from passing through aperture 40 since the inner diameter of aperture 40 is sized to be less than the diameter of roller 42.

By urging roller 42 against and into groove 34, axial movement is prevented by the coaction between the roller and groove while rotational movement is still allowed for the positioning of the light on an object to be illuminated. In addition, a plurality of rollers may be used as well for ease of rotational movement.

To disengage worklight 12 from support 32, roller 42 is released from its engagement with groove 34. To do this, outer sleeve 23 is actuated in a manner to remove finger 45 from its engagement with roller 42. This causes roller 42 to travel downwardly on sloped surface 50 away from and out of groove 34. Once roller 42 clears groove 34, the light may be disengaged from the support.

Figure 6:
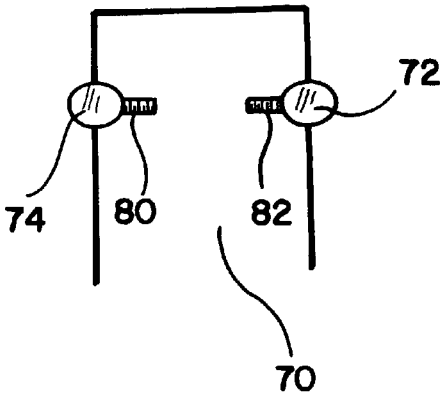
FIG. 6 shows an alternate embodiment of the present innovation in which the groove is located in the catch and the roller on the post.

As shown in FIGS. 6 and 7, the location of the groove and roller may be switched. As shown, catch 60 defines a bore 64 in which groove 62 is located. Post 70, on the other hand, may include thereon rollers 72 and 74 which partially extend from the post and are adapted to be depressed into post 70. In use, coaction between groove 62 and rollers 72 and 74 is similar to the groove/roller engagement described above. As post 70 is inserted into bore 64, rollers 72 and 74 are urged inwardly until they coact with groove 62. Then, the rollers spring outwardly to inhibit any further axially movement while permitting rotational movement as described above.

It should be understood that various changes and modifications to the preferred embodiments described would be apparent to those skilled in the art. Changes and modifications can be made without departing from the spirit and scope of the present invention and without diminishing its intended advantages. It is, therefore, intended that such changes and modifications be covered by the following claims.

What is claimed is:

1. A worklight mounting system comprising:

a post extending from a support having a groove;

a light housing having a catch having an internally located at least one roller; and said groove and said at least one roller coact to releasably engage said post to said catch, said coaction prevents axial movement between said post and said catch while permitting rotational movement there between.

2. A worklight mounting system comprising:

a post extending from a support, said post having a groove;

a light housing including a catch, said catch comprised of coaxially aligned inner and outer sleeves;

at lease one aperture on said inner sleeve and at least one roller disposed therein, said aperture including a surface which is directed downwardly towards said outer sleeve;

a bore defined by said inner sleeve, said bore adapted to receive said post;

a finger on said outer sleeve, said finger adapted to urge said roller against said groove to permit said roller and said groove to coact to secure said post within said catch; and said outer sleeve adapted to be actuated, said actuation releases said finger from engaging said roller which permits said roller to be disengaged from said groove whereby said catch and said post may be separated.

3. The device of claim 2 further including a spring, said spring maintains said finger in a position to urge said finger against said roller.

4. A worklight mounting system comprising:

a post extending from a support;

at least one roller partially extending outwardly from said post;

a light housing having a catch, said catch defining a bore adapted to receive said post and a groove adapted to coact with said roller;

said coaction between said roller and said groove releasably secures said post within said catch while permitting said catch to rotate about said post.

5. The device of claim 4 wherein said roller is urged outwardly from said post by a spring.

* * * * *